US010156401B2

(12) United States Patent
Blanchard et al.

(10) Patent No.: US 10,156,401 B2
(45) Date of Patent: Dec. 18, 2018

(54) PLATE HEAT EXCHANGER WITH DISTRIBUTION TUBES

(71) Applicants: ALFA LAVAL CORPORATE AB, Lund (SE); ALFA LAVAL VICARB SAS, St.-Egrève (FR)

(72) Inventors: Mickael Blanchard, Crolles (FR); Jean-Noël Fernandez, Chaponost (FR)

(73) Assignees: ALFA LAVAL CORPORATE AB, Lund (SE); ALFA LAVAL VICARB SAS, St.-Egréve (FR)

( * ) Notice: Subject to any disclaimer, the term of this patent is extended or adjusted under 35 U.S.C. 154(b) by 0 days.

(21) Appl. No.: 15/310,615

(22) PCT Filed: Mar. 25, 2015

(86) PCT No.: PCT/EP2015/056421
§ 371 (c)(1),
(2) Date: Nov. 11, 2016

(87) PCT Pub. No.: WO2015/172927
PCT Pub. Date: Nov. 19, 2015

(65) Prior Publication Data

US 2017/0082376 A1 Mar. 23, 2017

(30) Foreign Application Priority Data

May 13, 2014 (EP) ..... 14168124

(51) Int. Cl.
*F28D 7/00* (2006.01)
*F28F 9/22* (2006.01)
(Continued)

(52) U.S. Cl.
CPC ..... *F28D 9/0006* (2013.01); *F28D 9/0043* (2013.01); *F28F 3/08* (2013.01);
(Continued)

(58) Field of Classification Search
CPC ..... F28D 9/0006; F28D 1/04; F28F 9/0273; F28F 2210/10; F28F 2275/061
(Continued)

(56) References Cited

U.S. PATENT DOCUMENTS 4,274,482 A * 6/1981 Sonoda ..... B60H 1/3227 165/153
6,474,408 B1 * 11/2002 Yeh ..... F28D 9/0043 165/81
(Continued)

FOREIGN PATENT DOCUMENTS

CN 2903883 Y 5/2007
CN 103090708 A 5/2013
(Continued)

OTHER PUBLICATIONS

Translation of Japanese Patent Document JPH0590167U entitled Translation—JPH0590167U.*
(Continued)

*Primary Examiner* — Len Tran
*Assistant Examiner* — Paul Alvare
(74) *Attorney, Agent, or Firm* — Buchanan Ingersoll & Rooney PC

(57) ABSTRACT

A plate heat exchanger includes a casing in which heat transfer plates are arranged, wherein a first distribution tube and a second distribution tube that extend through respective first port openings and second port openings of the heat transfer plates includes outlets and inlets that face each other, a first passage and a second passage extend along the casing and along first sides and second sides of the heat transfer plates and comprise outlets and inlets that face each other.

19 Claims, 6 Drawing Sheets

(51) Int. Cl.

| | |
|---|---|
| ***F28D 9/00*** | (2006.01) |
| ***F28F 3/08*** | (2006.01) |
| *F28F 9/02* | (2006.01) |
| *F28D 1/04* | (2006.01) |

(52) U.S. Cl.
CPC ..... *F28F 9/027* (2013.01); *F28D 1/04* (2013.01); *F28F 9/0273* (2013.01); *F28F 2009/226* (2013.01); *F28F 2225/00* (2013.01)

(58) Field of Classification Search
USPC ..... 165/159, 161, 167, 906
See application file for complete search history.

(56) References Cited

U.S. PATENT DOCUMENTS

| | | | | |
|---|---|---|---|---|
| 8,240,367 | B2 | 8/2012 | Wanni et al. | |
| 2002/0174978 | A1* | 11/2002 | Beddome | F28D 9/0043 165/174 |
| 2003/0000688 | A1* | 1/2003 | Mathur | F28D 9/0006 165/167 |
| 2004/0031600 | A1 | 2/2004 | Kontu | |
| 2004/0069473 | A1 | 4/2004 | Blomgren et al. | |
| 2009/0000777 | A1 | 1/2009 | Wanni et al. | |
| 2010/0116474 | A1* | 5/2010 | Kerler | F25B 39/022 165/148 |
| 2013/0133866 | A1* | 5/2013 | Kinder | F28D 9/0056 165/151 |
| 2013/0299146 | A1 | 11/2013 | Blomgren | |
| 2014/0131025 | A1 | 5/2014 | Blomgren | |
| 2014/0305620 | A1 | 10/2014 | Heiniö | |

FOREIGN PATENT DOCUMENTS

| | | | |
|---|---|---|---|
| DE | 10 2004 004 895 | B1 | 6/2005 |
| EP | 1 038 147 | B1 | 4/2007 |
| EP | 2 508 831 | A1 | 10/2012 |
| EP | 2 527 775 | A1 | 11/2012 |
| FR | 2 967 247 | B1 | 11/2012 |
| JP | 50-128162 | U | 4/1974 |
| JP | S53-5646 | Y2 | 2/1978 |
| JP | 60-050388 | U | 4/1985 |
| JP | 62-075395 | U | 5/1987 |
| JP | S63-197977 | U | 12/1988 |
| JP | 05-090167 | U | 12/1993 |
| JP | H0590167 | U * | 12/1993 |
| JP | H07-098188 | A | 4/1995 |
| JP | 09-138082 | A | 5/1997 |
| WO | WO 02/16852 | A1 | 2/2002 |
| WO | WO 2010/149858 | A1 | 12/2010 |
| WO | WO 2011/161323 | A1 | 12/2011 |
| WO | WO 2013/072566 | A1 | 5/2013 |
| WO | WO 2013072566 | A1 * | 5/2013 |

OTHER PUBLICATIONS

International Search Report (PCT/ISA/210) dated Aug. 5, 2015, by the European Patent Office as the International Searching Authority for International Application No. PCT/EP2015/056421.

Written Opinion (PCT/ISA/237) dated Aug. 5, 2015, by the European Patent Office as the International Searching Authority for International Application No. PCT/EP2015/056421.

Office Action (Notice of Preliminary Rejection) dated Feb. 21, 2018, by the Korean Intellectual Property Office in corresponding Korean Patent Application No. 10-2016-7034415, and an English Translation of the Office Action. (8 pages).

Office Action issued by the Japanese Patent Office dated Dec. 25, 2017 in corresponding Japanese Patent Application No. 2017-512103, and English-language translation of Office Action (10 pages).

English translation of a Chinese Office Action dated Mar. 21, 2018 issued in corresponding Chinese Patent Application No. 201580024785.9 (12 pages).

Chinese Office Action dated Oct. 15, 2018 issued in corresponding Chinese Patent Application No. 201580024785.9 (12 pages).

* cited by examiner

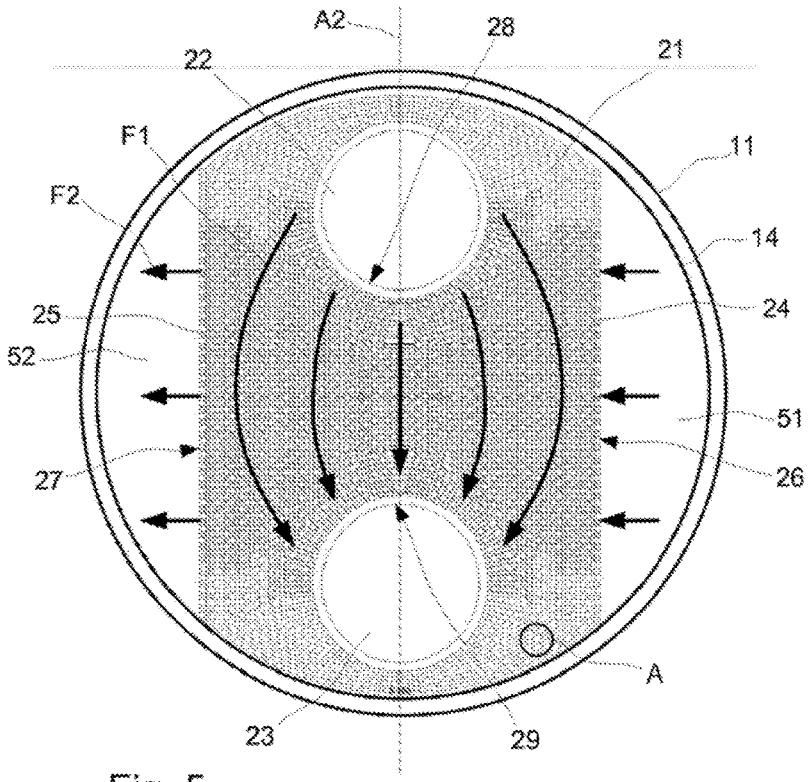
Fig. 5
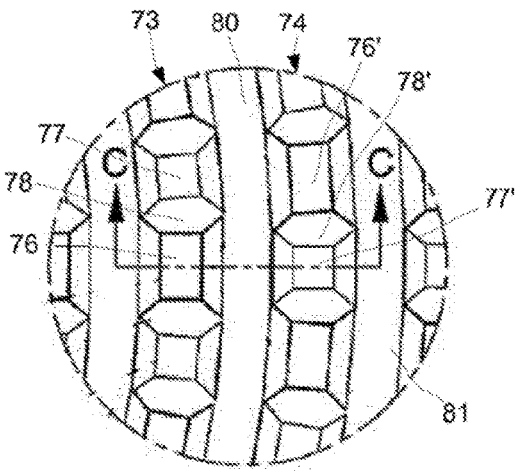
Fig. 6 (A)
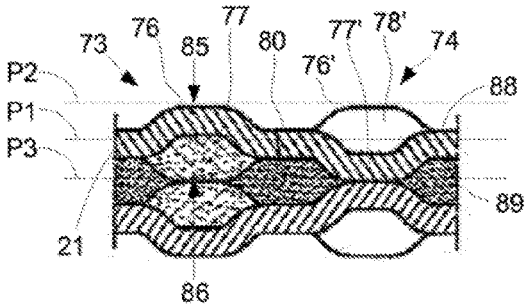
Fig. 7 (C-C)

PLATE HEAT EXCHANGER WITH DISTRIBUTION TUBES

TECHNICAL FIELD

The invention relates to a plate heat exchanger that has a casing and a number of heat transfer plates that comprises a respective first port opening, second port opening, first side and second side that is opposite the first side, wherein the heat transfer plates are arranged within the casing and permanently joined to each other. For the joined heat transfer plates a first set of flow channels for a first fluid is formed by every second interspace between the heat transfer plates, with fluid entries and fluid exits at the first and the second port openings. A second set of flow channels for a second fluid is formed by every other, second interspace between the heat transfer plates, with fluid entries and fluid exits at the first and second sides.

BACKGROUND ART

Today many different types of plate heat exchangers exist and are employed in various applications depending on their type. Some types of plate heat exchangers have a casing that forms a sealed enclosure in which heat transfer plates that are joined are arranged. The heat transfer plates form a stack of heat transfer plates where alternating first and second flow paths for a first and a second fluid are formed in between the heat transfer plates.

Since the heat transfer plates are surrounded by a casing, the heat exchanger may withstand high pressure levels in comparison with many other types of plate heat exchangers. Some examples of heat exchangers with a casing that surrounds heat transfer plates are found in patent documents EP2508831 and EP2527775. The plate heat exchangers disclosed by these documents handle high pressure levels well. However, in some applications the shell has to be relatively thick to be able to handle the desired pressure levels, which increases the total weight as well as the overall cost of the heat exchanger.

Thus, it is estimated that there is a need for a new type of plate heat exchanger that may withstand high pressure levels, while still requiring relatively less material for its casing than some other types plate heat exchangers do.

SUMMARY

It is an object of the invention to at least partly overcome one or more of the above-identified limitations of the prior art. In particular, it is an object to provide a new type of plate heat exchanger that may withstand high pressure levels, preferably while still using relatively little material for a casing in which heat transfer plates are arranged.

To solve these objects a plate heat exchanger is provided, which comprises a casing and a number of heat transfer plates of which each comprises a first port opening, a second port opening, a first side and a second side that is opposite the first side. The heat transfer plates are arranged within the casing and permanently joined to each other such that: i) a first set of flow channels for a first fluid is formed by every second interspace between the heat transfer plates, with fluid entries and fluid exits at the first and the second port openings, and ii) a second set of flow channels for a second fluid is formed by every other, second interspace between the heat transfer plates, with fluid entries and fluid exits at the first and second sides.

The a plate heat exchanger has a first distribution tube that extends through the first port openings of the heat transfer plates and comprises a fluid outlet and fluid inlet that are separated from each other by a first fluid blocker. A second distribution tube extends through the second port openings of the heat transfer plates and comprises a fluid inlet and a fluid outlet, the fluid inlet of the second distribution tube being arranged, as seen across the heat transfer plates, opposite the fluid outlet of the first distribution tube and the fluid outlet of the second distribution tube being arranged, as seen across the heat transfer plates, opposite the fluid inlet of the first distribution tube. A first passage extends along the casing and the first sides of the heat transfer plates and comprises a fluid outlet section and fluid inlet section that are separated from each other by a second fluid blocker, and a second passage extends along the casing and the second sides of the heat transfer plates and comprises a fluid inlet section and a fluid outlet section, the fluid inlet section of the second passage being arranged, as seen across the heat transfer plates, opposite the fluid outlet section of the first passage and the fluid outlet section of the second passage being arranged, as seen across the heat transfer plates, opposite the fluid inlet section of the first passage.

Since the distribution tubes are arranged in the port openings of the heat transfer plates so called snaking, i.e. movement or twisting of the heat transfer plates relative each other, is prevented. This makes the plate heat exchanger more durable and capable of withstanding high pressures.

A number of the heat transfer plates may have the shape of a circular disc with two cut sides that form the first side and the second side that is opposite the first side. Generally, all or most of heat transfer plates have this shape.

Each or some of the heat transfer plate may comprise a number of rows where each row has alternating ridges and grooves that extend along a central plane of the heat transfer plate, between a top plane and a bottom plane of the heat transfer plate, the top plane and bottom plane being substantially parallel to the central plane and located on a respective side of the central plane, where a transition between each ridge and adjacent groove in the same row is formed by a portion of the heat transfer plate that is inclined relative the central plane. The plate has also plate portions that extend along the central plane of the heat transfer plate, between the rows of ridges and grooves such that the rows are separated from each other. This structure of rows that are separated from each other provides a very durable heat transfer plate.

At least some of the rows of alternating ridges and grooves may be parallel to the first side and the second side.

The first and second distribution tubes may extend from a top cover to a bottom cover of the casing. The first and second distribution tubes may be attached to the top cover and to the bottom cover. Distribution tubes that incorporate one or more of these features provide a more durable plate heat exchanger, at they may fix the covers of the plate heat exchanger relative each other.

The plate heat exchanger may comprise two end plates that are arranged on a respective side of the joined heat transfer plates, wherein the first and second distribution tubes are attached to each of the end plates. The end plates are typically thicker than the heat transfer plates and improves the capability for the heat transfer plates to withstand high pressures. The end plates may be e.g. flat.

At least every second heat transfer plate may comprise a by-pass blocker that is folded into a gap formed at peripheral edges of the at least every second heat transfer plate and an adjacent heat transfer plate. The by-pass blocker may have the form a stamped, integral piece of the at least every second heat transfer plate before it is folded into the gap.

The first fluid blocker in the first distribution tube may comprise a disc with a peripheral edge that that is attached to the interior of the first distribution tube.

The second fluid blocker may comprise a peripheral edge that extends along the first side of a heat transfer plate of the heat transfer plates and along an inner surface of the casing. The second fluid blocker may be integral with said heat transfer plate along which the second fluid blocker extends.

The plate heat exchanger may comprise a rod that extends along the first passage, from an interior support surface of the casing and to the second fluid blocker, such that the second fluid blocker is supported in a direction along the first passage.

The first distribution tube may comprise a second fluid outlet that is located next to the fluid inlet of the first distribution tube, and the second distribution tube may comprise a second fluid inlet that is arranged, as seen across the heat transfer plates, opposite the second fluid outlet of the first distribution tube, and that is separated from the fluid outlet of the second distribution tube by a third fluid blocker. The first passage may comprise a second fluid outlet section that is located next to the fluid inlet section of the first passage, and the second passage may comprise a second fluid inlet section that is arranged, as seen across the heat transfer plates, opposite the second fluid outlet section of the first passage, and that is separated from the fluid outlet section of the second passage by a fourth fluid blocker.

Still other objectives, features, aspects and advantages of the invention will appear from the following detailed description as well as from the drawings.

BRIEF DESCRIPTION OF THE DRAWINGS

Embodiments of the invention will now be described, by way of example, with reference to the accompanying schematic drawings, in which FIG. 5 is a top-view of a heat transfer plate used for the heat exchanger of FIG. 1, FIG. 6 is an enlarged view of section A in FIG. 5, FIG. 7 is a cross-sectional side view as seen along line C-C in FIG. 6, when the heat transfer plate is arranged on top of a similar heat transfer plate.

DETAILED DESCRIPTION

Figure 1:
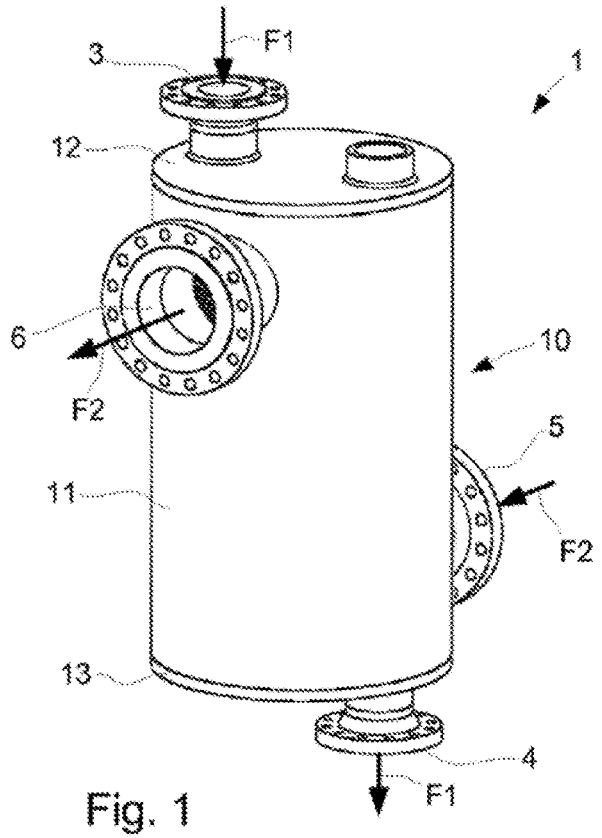
FIG. 1 is a perspective view of a plate heat exchanger.
Figure 2:
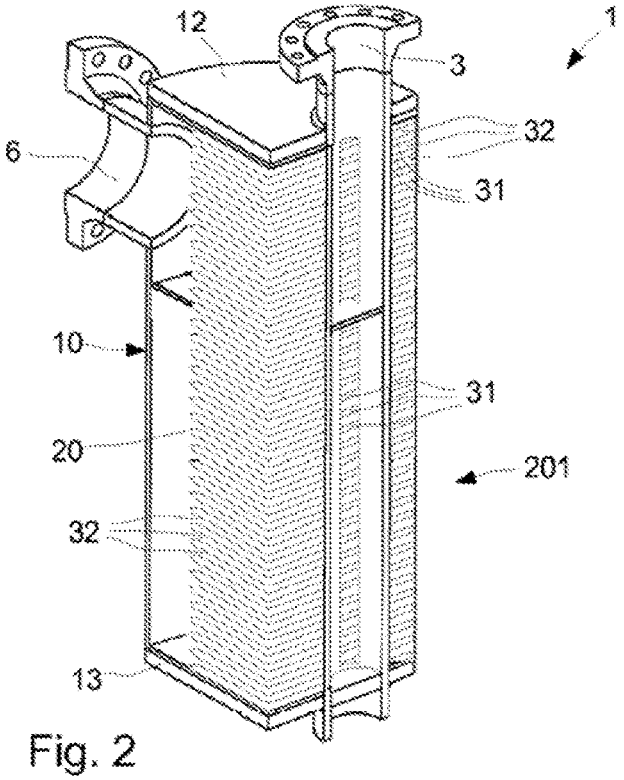
FIG. 2 is a cross-sectional, perspective view of the heat exchanger of FIG. 1, with the cross-sectional views seen along an inlet for a first fluid and an outlet for a second fluid.

With reference to FIGS. 1 and 2 a plate heat exchanger 1 is illustrated. All illustrated parts of the plate heat exchanger 1 are generally made of metal. Some parts like conventional gaskets may be made of other materials. The plate heat exchanger 1 has a casing 10 in the form of a cylindrical shell 11 that is sealed by a top cover 12 and a bottom cover 13, such that a sealed enclosure is formed within the casing 10. The plate heat exchanger 1 has in the top cover 12 a first heat exchanger inlet 3 for a first fluid F1 and has in the bottom cover 13 a first heat exchanger outlet 4 for the first fluid F1. A second heat exchanger inlet 5 for a second fluid F2 is arranged in the cylindrical shell 11, at an end of the cylindrical shell 11 that is proximate the bottom cover 13. A second heat exchanger outlet 6 for the second fluid F2 is arranged in the cylindrical shell 11, at an end of the cylindrical shell 11 that is proximate the top cover 12. Each of the inlets 3, 5 and outlets 4, 6 has a flange that facilitates connection of the inlets 3, 5 and outlets 4, 6 to pipes that convey the first fluid F1 and the second fluid F2.

A number of heat transfer plates 20 are arranged within the casing 10 and are permanently joined to each other, for example by welding, to form a stack of heat transfer plates 201, such that interspaces are formed between each heat transfer plates in the stack 201. Every second interspace between the heat transfer plates 20 forms a first set of flow channels 31 for the first fluid F1, while every other, second interspace between the heat transfer plates 20 forms a second set of flow channels 32 for the second fluid F2.

With further reference to FIG. 5 a heat transfer plate 21 is shown. The heat transfer plates 20 within the casing 10 may each be of the same type as the heat transfer plate 21. Every or some heat transfer plate in the stack 201 may have the form of the heat transfer plate 21 shown in FIG. 5. However, every second heat transfer plate in the stack 201 may be rotated 180° about an axis A2 that is parallel to the heat transfer plate 21 and that extends through a center of the heat transfer plate 21.

To accomplish the first set of flow channels 31 and the second set of flow channels 32, a first port opening 22 and a second port opening 23 of a heat transfer plate 21 in the stack 201 is welded to similar first and second port openings of a first, adjacent (upper) heat transfer plate, around their entire peripheries such that a flow boundary is formed for the second fluid F2. Additionally, the entire periphery of the heat transfer plate 21 in the stack 201 is welded to similar periphery of a second, adjacent (lower) heat transfer plate. This is done for all plates in the stack 201. The first fluid F1 may then enter the heat transfer plates 20 only via first port openings 22 and second port openings 23, while it cannot escape outside the periphery of the heat transfer plates 20. The second fluid F2 may enter the heat transfer plates 20 at their peripheries but will not flow into the port openings since they are sealed. In other words, the heat transfer plates 20 are joined to each other alternatively at their ports respectively at their peripheries. The space, or channels, formed between the heat transfer plates 20 are referred to as interspaces.

The first set of flow channels 31 for the first fluid F1 is then formed between every second interspace between the heat transfer plates 20, with fluid entries 28 at the first port opening 22 and fluid exits 29 at the second port openings 23. When the flow of the first fluid F1 over a heat transfer plate 21 is reversed, then the fluid entry 28 at the first port opening 22 becomes a fluid exit and the and the fluid exit 29 at the second port opening 23 becomes a fluid entry.

The second set of flow channels 32 for the second fluid F2 is formed between every other, second interspace between the heat transfer plates 20, with fluid entries 26 at the first sides 24 (peripheral edges 24) and fluid exits 27 at the second sides 25 (peripheral edges 25). When the flow of the second fluid F2 over a heat transfer plate 21 is reversed, then the fluid entry 26 at the first side 24 becomes a fluid exit and the and the fluid exit 27 at the second side 25 becomes a fluid entry.

As will be further shown below, the flow direction of the first fluid F1 is for some of the heat transfer plates in the stack 201 opposite that of some of the other heat transfer plates, which means that the first set of flow channels 31 has fluid entries at the first port openings 22 and exits and the second port openings 23, or entries at the second port openings 23 and exits at the first port openings 22, depending on at which port opening the first fluid F1 enters. In a similar manner, the flow direction of the second fluid F2 is for some of the heat transfer plates in the stack 201 opposite that of some of the other heat transfer plates. This means that the second set of flow channels 32 has fluid entries at the first sides 24 and exits at the second sides 25, or entries at the second sides 25 and exits at the first sides 24, depending on at which side the second fluid F2 enters.

Figure 3:
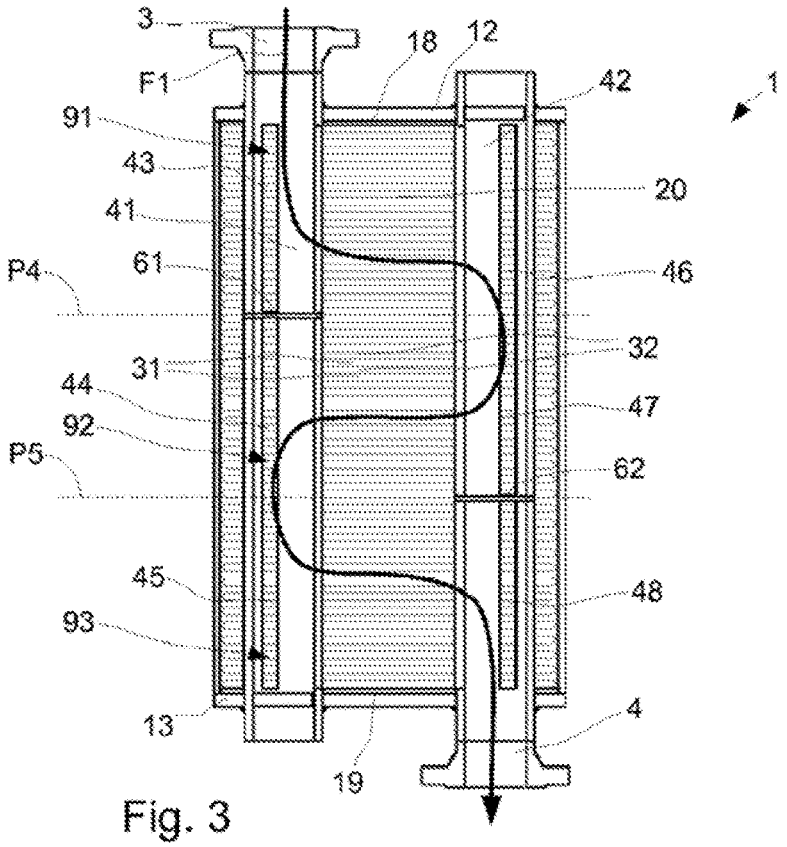
FIG. 3, is a cross-sectional view of the heat exchanger of FIG. 1, showing a flow path of the first fluid.

With reference to FIG. 3, the plate heat exchanger 1 has a first distribution tube 41 that extends through the first port openings 22 of the heat transfer plates 20. The first distribution tube 41 and has a fluid outlet 43 and fluid inlet 44 that are separated from each other by a first fluid blocker 61. Each of the fluid outlet 43 and the fluid inlet 44 of the first distribution tube 41 has the shape of an elongated opening, or through hole, that extends along a respective length of the first distribution tube 41. The first fluid blocker 61 has the shape of disc that is, at a peripheral edge of the disc 61, welded to the interior of the first distribution tube 41, such that no fluid may flow past the first fluid blocker 61. An end of the first distribution tube 41 that extends through the top cover 12 forms the first heat exchanger inlet 3.

The plate heat exchanger 1 has second distribution tube 42 that extends through the second port openings 23 of the heat transfer plates 20. The second distribution tube 42 has a fluid inlet 46 and a fluid outlet 47. The fluid inlet 46 of the second distribution tube 42 is arranged, as seen across the heat transfer plates 20, opposite the fluid outlet 43 of the first distribution tube 41. The fluid outlet 47 of the second distribution tube 42 is arranged, as seen across the heat transfer plates 20, opposite the fluid inlet 44 of the first distribution tube 41. Each of the fluid inlet 46 and the fluid outlet 47 of the second distribution tube 42 has the shape of an elongated opening, or through hole, that extends along a respective length of the second distribution tube 42.

In this context, "across the heat transfer plates" may refer to a first direction from the first port opening 22 to the second port opening 23 of a heat transfer plate heat transfer plate 21, or to a second direction that is opposite the first direction.

The fluid outlet 43 of the first distribution tube 41 is an outlet in the sense that the first fluid F1 may, after it has entered the first distribution tube 41 via the first heat exchanger inlet 3, flow out from the first distribution tube 41 via the fluid outlet 43 and into interspaces between the heat transfer plates 20, where the fluid entries 28 of the first port openings 22 face the first distribution tube 41. Thus, all fluid entries 28 at first port openings 22 of heat transfer plates that face the fluid outlet 43 of the first distribution tube 41 will receive the first fluid F1 from the first distribution tube 41. In these interspaces the first fluid F1 flows across heat transfer plates and eventually out from the interspaces at the fluid exits 29 of the second port openings 23. The fluid thereafter flows into the fluid inlet 46 of the second distribution tube 42, thus making the fluid inlet 46 an "inlet". This applies for all heat transfer plates between plane P4 in FIG. 3 and the top cover 12.

When the first fluid F1 has flown into the second distribution tube 42 via the fluid inlet 46, it flows further in the second distribution tube 42 and to the fluid outlet 47 where it, at the second port openings 23, leaves the second distribution tube 42 via the fluid outlet 47 (making the fluid outlet 47 act as an "outlet"). The first fluid F1 then enters interspaces between the heat transfer plates 20, at the second port openings 23 of the heat transfer plates 20 which thereby act as fluid entries. The first fluid F1 then flows in the interspaces, i.e. across heat transfer plates, exits the interspaces at the first port openings 22, which thereby act as fluid exits, and flows into the first distribution tube 41 via its fluid inlet 44. The flow of the first fluid F1 from the fluid outlet 47 of the second distribution tube 42 to the fluid inlet 44 of the first distribution tube 41 applies for all heat transfer plates that are located between plane P4 and P5 in FIG. 3.

The first distribution tube 41 has also a second fluid outlet 45 that is located next to its fluid inlet 44. The second distribution tube has a second fluid inlet 48 that is located, as seen across the heat transfer plates 20, opposite the second fluid outlet 45 of the first distribution tube 41. The second fluid inlet 48 is separated from the fluid outlet 47 of the second distribution tube 42 by a third fluid blocker 62.

Each of the second fluid outlet 45 of the first distribution tube 41 and the second fluid inlet 48 of the second distribution tube 42 has the shape of an elongated opening, or through hole, that extends along a length of the first distribution tube 41 respectively along a length of second distribution tube 42. The third fluid blocker 62 has the shape of disc that is, at a peripheral edge of the disc, welded to the interior of the second distribution tube 42, such that no fluid may flow past the third fluid blocker 62.

Thus, after the first fluid F1 has entered the first distribution tube 41 via its fluid inlet 44, it flows further in the first distribution tube 41 and to its second fluid outlet 45. From the second fluid outlet 45 the first fluid F1 leaves the first distribution tube 41 via the second fluid outlet 45 and flows into interspaces at the first port opening 22. The first fluid F1 then flows in the interspaces, across the heat transfer plates that form the interspaces, out from the interspaces via second port openings 23 of the heat transfer plates 20 and into the second distribution tube 42 via the second fluid inlet 48. The flow of the first fluid F1 from the second fluid outlet 45 of the first distribution tube 41 to the second fluid inlet 48 of the second distribution tube 42 applies for all heat transfer plates that are located between the plane P5 and the bottom cover 13. The first fluid F1 exits the second distribution tube 42 via the first heat exchanger outlet 4, which is formed by a part of the second distribution tube 42 that extends out through the bottom cover 13.

The general flow path of the first fluid F1 is illustrated by the curved arrow marked with reference numeral "F1".

As may be seen, the first and second distribution tubes 41, 42 extend from the top cover 12 to the bottom cover 13 of the casing 10. The first distribution tube 41 has an end that extends through the bottom cover 13 and the second distribution tube 42 has an end that extends through the top cover 12. The ends that extend through the covers 12, 13 are sealed such that no fluid may leak out from the plate heat exchanger 1. The first and second distribution tubes 41, 42 are both attached to the top cover 12 and to the bottom cover 13, typically by welding, which increases the pressure resistance of the plate heat exchanger 1.

A first end plate 18 is arranged between the heat transfer plates 20 and the top cover 12, and a second end plate 19 is arranged between the heat transfer plates 20 and the bottom cover 13. Each of the first and second distribution tubes 41, 42 are welded to the end plates 18, 19, typically at ports of the end plates through which the distributions tubes 41, 42 extends.

Figure 4:
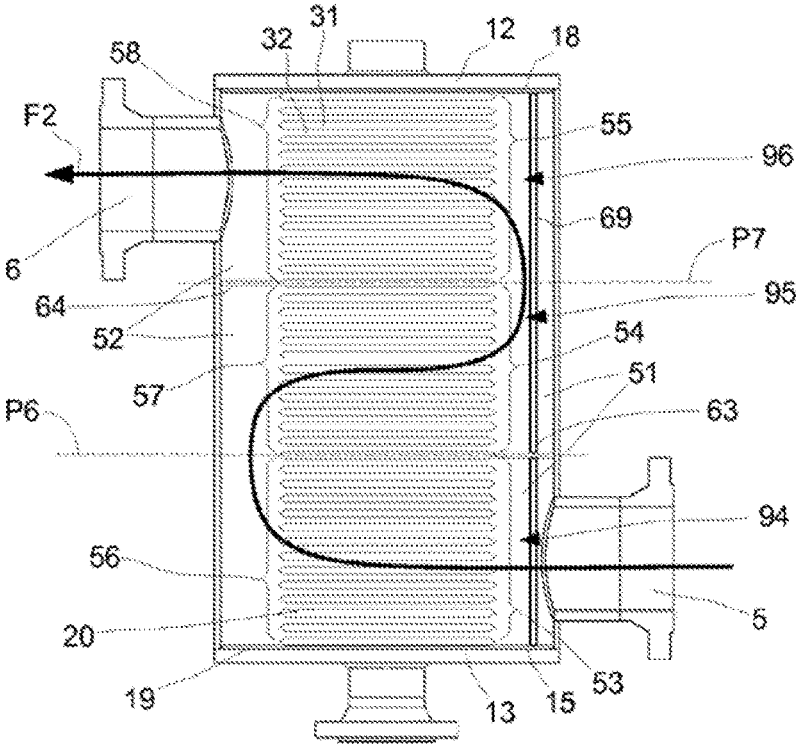
FIG. 4, is a cross-sectional view of the heat exchanger of FIG. 1, showing a flow path of the second fluid.

With reference to FIG. 4, the plate heat exchanger 1 has a first passage 51 that extends along the casing 10 and the first sides 24 of the heat transfer plates 20. The first passage 51 has a fluid outlet section 53 and fluid inlet section 54 that are separated from each other by a second fluid blocker 63.

The plate heat exchanger 1 has also a second passage 52, which extends along the casing 10 and the second sides 25 of the heat transfer plates 20. Thus, the second passage 52 is, as seen across the heat transfer plates 20, opposite the first passage 51. The second passage 52 has a fluid inlet section 56 and a fluid outlet section 57. The fluid inlet section 56 is arranged, as seen across the heat transfer plates 20, opposite the fluid outlet section 53 of the first passage 51. The fluid outlet section 57 of the second passage 52 is arranged, as seen across the heat transfer plates 20, opposite the fluid inlet section 54 of the first passage.

The first passage 51 has a second fluid outlet section 55 that is located next to its fluid inlet section 54. The second passage 52 has a second fluid inlet section 58 that is arranged, as seen across the heat transfer plates 20, opposite the second fluid outlet section 55 of the first passage 51. The second fluid inlet section 58 of the second passage 52 is separated from the fluid outlet section 57 of the second passage 52 by a fourth fluid blocker 64.

In detail, the first passage 51 is formed by a space between the first sides 24 of the heat transfer plates 20 and an interior surface 14 (see FIG. 5) of the cylindrical shell 11 that faces the first sides 24, between the top cover 12 and the bottom cover 13. The second passage 52 is formed by a corresponding space between the second sides 25 of the heat transfer plates 20 and surface of the cylindrical shell 11 that faces the second sides 25, between the top cover 12 and the bottom cover 13.

The second fluid F2 enters the first passage 51 via the second heat exchanger inlet 5. The second fluid F2 next leaves the first passage 51 by flowing out from the first passage 51 via the fluid outlet section 53 of the first passage 51, into interspaces between the heat transfer plates 20 at the first sides 24 of the heat transfer plates 20 where the fluid entries 26 are located. All interspaces, or openings at the first sides 24 of the heat transfer plates 20, that are located between the bottom cover 13 and the plane P6 form the fluid outlet section 53 of the first passage 51. Thus, when the second fluid F2 flows out from the first passage 51, it flows into interspaces that are part of the second set of flow channels 32. The second fluid F2 then flows across heat transfer plates 20 and exits the heat transfer plates 20 at the inlet section 56 of the second passage 52, i.e. the second fluid F2 flows into the second passage 52 at its fluid inlet section 56. All interspaces, or openings at the second sides 25 of the heat transfer plates 20 that are located between the bottom cover 13 and the plane P6 form the fluid inlet section 56 for the second passage 52.

After the second fluid F2 has entered the second passage 52 via the fluid inlet section 56, it flows in the second passage 52, towards the fluid outlet section 57 of the second passage 52. All interspaces, or openings at second side 25 of the heat transfer plates 20 that are located between plane P6 and the fourth fluid blocker 64, or plane P7, form the fluid outlet section 57 of the second passage 52. The second fluid F2 flows out from the second passage 52, into the interspaces of the fluid outlet section 57, across heat transfer plates 20 and exits the interspaces via the fluid inlet section 54 of the first passage 51. All interspaces, or openings at the first sides 24 of the heat transfer plates 20 that are located between the plane P6 and plane P7, form the fluid inlet section 54 of the first passage 51.

When the second fluid F2 has entered the first passage 51 via the fluid inlet section 54, it flows in the first passage 51, towards the second fluid outlet section 55 of the second passage 52. All interspaces, or openings at first sides 24 of the heat transfer plates 20 that are located between plane P7 and the top cover 12, form the second fluid outlet section 55 of the first passage 51. The second fluid F2 flows via the second fluid outlet section 55 out from the first passage 51, into the interspaces of the second fluid outlet section 55, across heat transfer plates 20 and exits the interspaces via the second fluid inlet section 58 of the second passage 52. All interspaces, or openings at the second side 25 of the heat transfer plates 20 that are located between the plane P7 and the top cover 12 form the second fluid inlet section 58 of the second passage 52. After the second fluid F2 has flown into the second passage 52 at the second fluid inlet section 58, it exits the second passage 52 via the second heat exchanger outlet 6.

The flow path of the second fluid F2 is illustrated by the curved arrow marked with reference numeral "F2".

As may be seen, the planes P4-P7 are defined by the fluid blockers 61-64. Specifically, plane P4 coincides with the first fluid blocker 61, plane P6 coincides with the second fluid blocker 63, plane P5 coincides with the third fluid blocker 62 and plane P7 coincides with the fourth fluid blocker 64.

Figure 13:
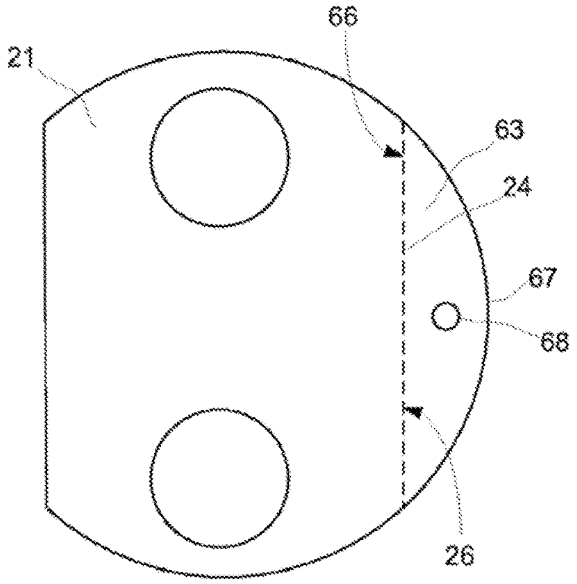
FIG. 13 is a top view of a first embodiment of a fluid blocker that may be used for the heat exchanger of FIG. 1.
Figure 14:
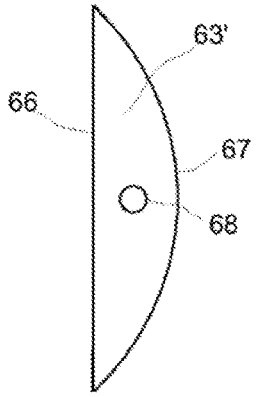
FIG. 14 is a top view of a second embodiment of a fluid blocker that may be used for the heat exchanger of FIG. 1, FIGS. 15-17 are principal views that illustrate a third embodiment of a by-pass blocker that may be used for the heat exchanger of FIG. 1, FIG. 18, is a first cross-sectional view of another embodiment of a heat exchanger, showing a flow path of a first fluid.

With reference to FIG. 13 the second fluid blocker 63 may be an integral part of a heat transfer plate 21, with a peripheral edge 67 that abuts the interior surface 14 (see FIG. 5) of the cylindrical shell 11 and with a peripheral edge section 66 that is joined with the first side 24 of the heat transfer plate 21. The second fluid blocker 63 may also have the form of a partial disc, as shown by the fluid blocker 63' of FIG. 14. The fluid blocker 63' also has a peripheral edge 66, 67 that extends along the first side 24 of the heat transfer plate 21 and along the inner surface 14 of the casing 10.

To support the second fluid blocker 63 the plate heat exchanger 1 may have a rod 69 (see FIG. 4) that extends along the first passage 51, from an interior support surface 15 of the casing 10 and to the second fluid blocker 63. The support surface 15 may be part of the end plate 19 or the bottom cover 13 in case no end plate is used. The rod 69 may typically extend from the support surface 15 and to a similar support surface on the other end plate 18, or on the top cover 12 in case no end plates are used. The rod 69 may then extend through a through hole 68 (see FIG. 13) in the second fluid blocker 63 and is, e.g. by a spot weld, connected to the second fluid blocker 63. This effectively accomplishes a support for the second fluid blocker 63, in a direction along the first passage 51. A similar rod may be arranged in the second passage 52 for supporting the fourth fluid blocker 64.

With reference to FIGS. 5-7 the heat transfer plate 21 that may be used for the heat exchanger 1 of FIG. 1 is shown. The heat transfer plate 21 has a number of rows 73, 74 where each row 73, 74 comprises alternating ridges and grooves, such as ridge 76 and groove 77 of row 73 and ridge 76' and groove 77' of row 74. The rows 73, 74 extend along a central plane P1 of heat transfer plate 21, between a top plane P2 and a bottom plane P3 of the heat transfer plate 21. The central plane P1 is typically a plane that extends in the center of the heat transfer plate 21, in the illustrated embodiment at equal distances from a top side of the heat transfer plate and a bottom side of the heat transfer plate 21. The top plane P2 and bottom plane P3 are substantially parallel to the central plane P1 and are located on a respective side of the central plane P1. A transition between each ridge 76 and adjacent groove 77 in the same row 73 is formed by a portion 78 of the heat transfer plate 21 that is inclined relative the central plane P1. The row 74 has a corresponding inclined portion 78' between ridge 76' and groove 77'. Flat elongated plate portions 80, 81 extend along the central plane P1 of the heat transfer plate, between the rows 73, 74 of ridges and grooves. The rows 73, 74 are thereby separated from each other. The flat elongated plate portions 80, 81 may be referred to as reinforcement sections. Generally, the central plane P1 is located in, or extends along, the center of the flat elongated plate portions 80, 81. The planes P1, P2 and P3 are seen from the side in FIG. 7.

The ridges 76 have respective top surface 85 on the top side 88 of the heat transfer plate 21 and the grooves 77 have a respective bottom surface 86 on the bottom side 89 of the heat transfer plate 21. The top side 88 may be referred to as a first side 88 of the heat transfer plate 21 and the bottom side 89 may be referred to as a second side 89 of the heat transfer plate 21. The top surface 85 has a contact area that abuts a heat transfer plate that is arranged above (on the top side 88 of) the heat transfer plate 21. The bottom surface 86 has a contact area that abuts a heat transfer plate that is arranged below (on the bottom side 89 of) the heat transfer plate 21. For several, most or even all of the ridges and grooves the contact area of the top surface 85 is larger than the contact area of the bottom surface 86. Some of the rows of alternating ridges and grooves are parallel to the first side 24 and the second side 25 of the heat transfer plate 21.

Figure 8:
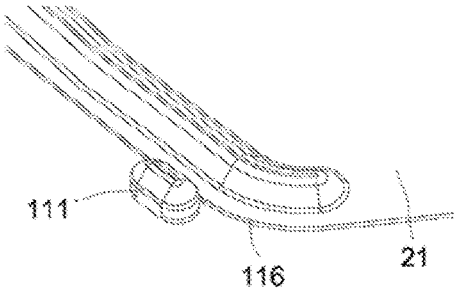
FIGS. 8 and 9 are perspective views of a first embodiment of a by-pass blocker that may be used for heat transfer plates of the kind shown in FIG. 5, FIGS. 10-12 are perspective views of a second embodiment of a by-pass blocker that may be used for heat transfer plates of the kind shown in FIG. 5.
Figure 9:
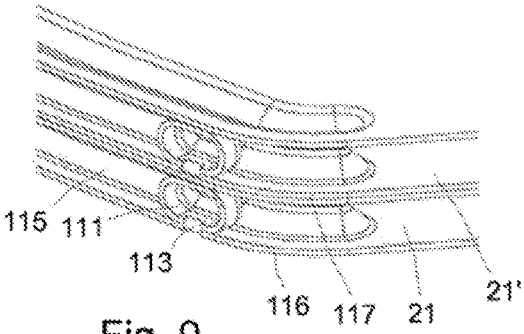

With reference to FIGS. 8 and 9, at least every second heat transfer plate 21 of the heat transfer plates 20 may have a by-pass blocker arrangement 111 that is folded into a gap 115 formed at the peripheral edges 116, 117 of the at least every second heat transfer plate 20 and an adjacent heat transfer plate 20'. The by-pass blocker 111 forms a stamped integral piece of the at least every second heat transfer plate 20 before it is folded into the gap 115. A section 113 between the by-pass blocker 111 and the heat transfer plate 21 forms a joint that facilitates the folding of the blocker 111.

Figure 10:
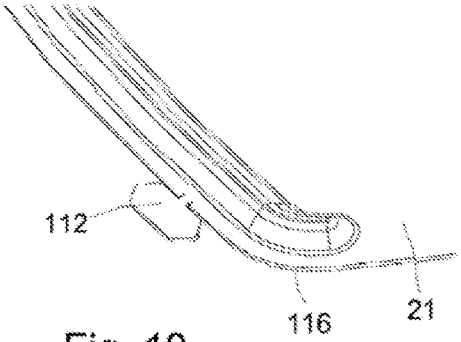
Figure 11:
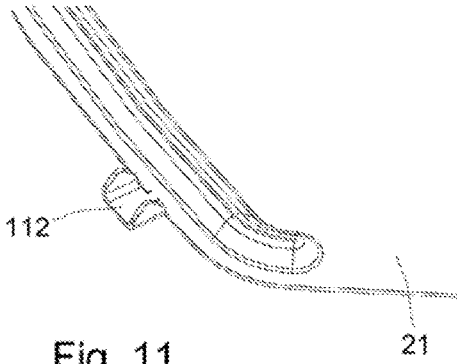
Figure 12:
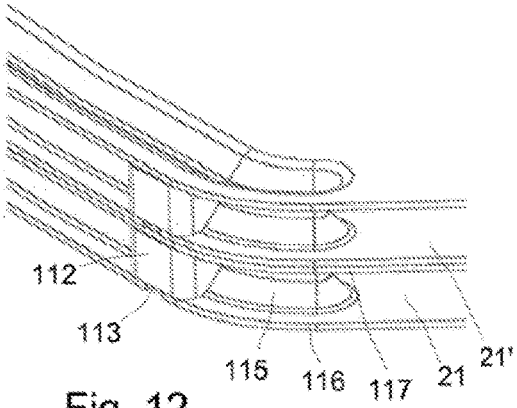

With reference to FIGS. 10-12 another embodiment of a by-pass blocker arrangement 112 is illustrated. The by-pass blocker 112 is shown unfolded in FIG. 10, with folded ends in FIG. 11, and folded into the gap 115 in FIG. 12. The by-pass blockers 111, 112 prevent the second fluid F2 from taking a short-cut between the heat transfer plates 20 and the inner surface of the cylindrical shell 11 when it flows between the first passage 51 and second passage 52 or in the opposite direction.

The by-pass blockers are typically located on the heat transfer plate 21 where the heat transfer plate 21 meets the cylindrical shell 11, and prevents the second fluid F2 from taking a short-cut between the heat transfer plates 20 and the inner surface of the cylindrical shell 11 when it flows between the first passage 51 and second passage 52 or in the opposite direction.

Figure 15:
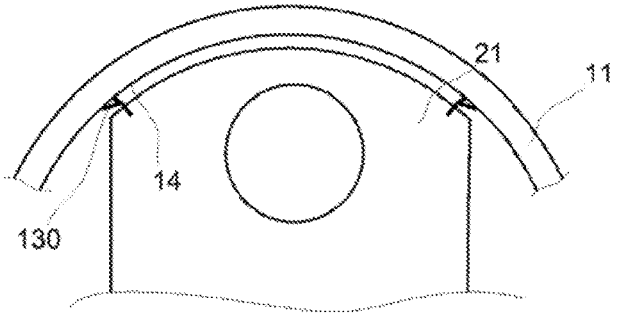
Figure 16:
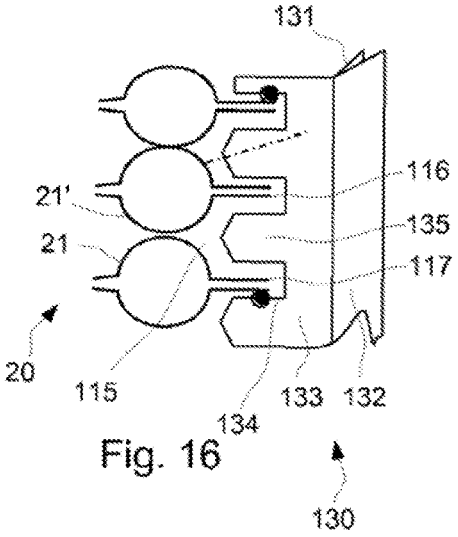
Figure 17:
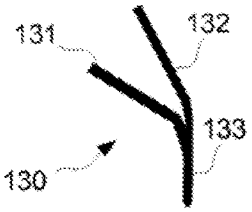

With reference to FIGS. 15-17, a third embodiment of a by-pass blocker arrangement 130 is illustrated. The by-pass blocker 130 is located on the heat transfer plates 20 where the heat transfer plates 20 meet the cylindrical shell 11, and prevents the second fluid F2 from taking a short-cut between the heat transfer plates 20 and the inner surface of the cylindrical shell 11 when it flows between the first passage 51 and second passage 52 or in the opposite direction. The by-pass blocker comprises a comb-like structure 133 that extends along the heat transfer plates 20, from the top cover 12 to the bottom cover 13. The comb-like structure 133 has protrusions 135 with gaps 134 into which the edges of the heat transfer plates 20 extends, and may be attached to the heat transfer plates 20 by spot-welds. From the comb-like structure 133 a first seal 131 and a second seal 132 extends. These seals, or sealing elements, 131, 132 are flexible such that they closely abut the interior surface of the cylindrical shell 11, when the by-pass blocker 130 with its sealing elements 131, 132 is arranged between the heat transfer plates 20 and the cylindrical shell 11.

Figure 18:
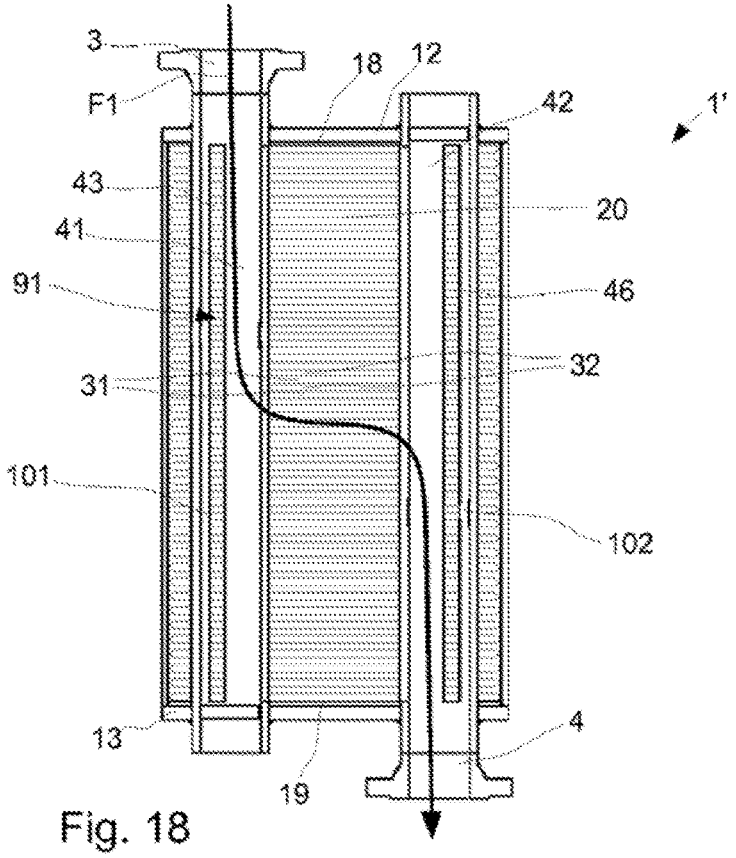

With reference to FIGS. 17 and 18, another embodiment of a plate heat exchanger 1' is illustrated. This heat exchanger 1' is similar to the heat exchanger 1 shown in e.g. FIGS. 3 and 4, but with the difference that it has a single pass configuration for both the first fluid F1 and the second fluid F2. This means that each of the fluids F1, F2 passes between the heat transfer plates 20 only once, as compared to three times in the heat exchanger 1 of FIGS. 3 and 4, which hence has a three pass configuration.

In detail, the heat exchanger 1' has a first distribution tube 41 that extends through the first port openings 22 of the heat transfer plates 20. The first distribution tube 41 and has a fluid inlet 3 and a fluid outlet 43. The fluid inlet 3 is a conventional tube inlet that is located at an end of the first distribution tube 41 and the fluid outlet 43 has the shape of an elongated opening, or through hole, that extends along a length of the first distribution tube 41.

The plate heat exchanger 1' has second distribution tube 42 that extends through the second port openings 23 of the heat transfer plates 20. The second distribution tube 42 and has a fluid inlet 46 and a fluid outlet 4. The fluid outlet 4 is a conventional tube outlet that is located at an end of the second distribution tube 42 and the fluid inlet 46 has the shape of an elongated opening, or through hole, that extends along a length of the second distribution tube 42. The fluid inlet 46 of the second distribution tube 42 is arranged, as seen across the heat transfer plates 20, opposite the fluid outlet 43 of the first distribution tube 41. The plate heat exchanger 1' has in its distribution tubes no fluid blockers like the fluid blockers 61 and 62 described above. All other features are same, but the absence of fluid blockers provides another flow path for the first fluid that results in a one pass configuration. The absence of fluid blockers give a general flow path of the first fluid F1 as illustrated by the curved arrow marked with reference numeral "F1".

Figure 19:
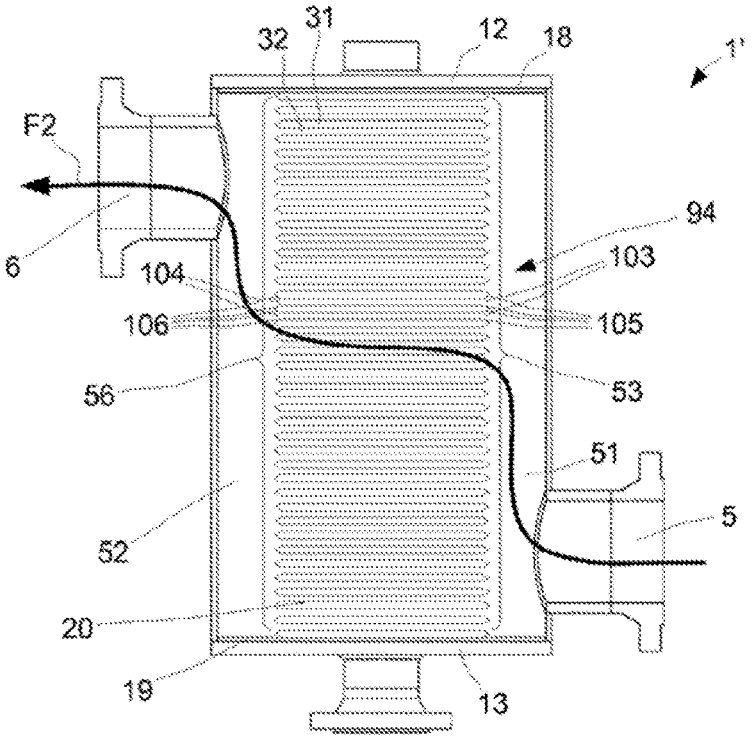
FIG. 19, is a second cross-sectional view of the heat exchanger of FIG. 18, showing a flow path of a second fluid.

The plate heat exchangers 1 and 1' of FIGS. 3 and 4 respectively FIGS. 18 and 19 each share the same concept in form of first and second distribution tubes 41, 42 that extends through the port openings 22, 23 of the heat transfer plates 20. The first distribution tube 41 comprises the fluid inlet 3 for the first fluid F1, and the fluid outlet 43, which faces at least a section 91 of the first set of flow channels 31. The first fluid F1 may then leave the first distribution tube 41 and enter said section 91 of the first set of flow channels 31.

In a one pass configuration the section 91 typically comprises the flow channels for the first fluid F1 for all heat transfer plates.

The second distribution tube 42 extends through the second port openings 23 of the heat transfer plates 20 and comprises the fluid inlet 46, which faces the above mentioned section 91 of the first set of flow channels 31, such that the first fluid F1 may leave said section 91 of the first set of flow channels 31 and enter the second distribution tube 42. The second distribution tube 42 has also the fluid outlet 4 for the first fluid F1.

Since the plate heat exchanger 1' of FIGS. 18 and 19 has no fluid blockers, there is only one section 91 of the first set of flow channels 31. Both the outlet 43 and the inlet 46 faces the section 91. The plate heat exchanger 1 of FIGS. 3 and 4 has two fluid blockers for the first fluid F1 and thus three sections 91, 92, 93 of the first set of flow channels 31. Each section 91, 92, 93 represents one fluid pass for the first fluid F1.

Other embodiments are conceivable. For example, in a two pass configuration the heat exchanger has the first fluid blocker 61 but not the second fluid blocker 62. The first fluid blocker may then be located in the middle of the first distribution tube. The outlet of the second distribution tube 42 would then be an outlet that faces a second section of the first set of flow channels 31, and the first distribution tube 41 would then have an outlet similar to fluid outlet 4 shown in FIG. 3.

The plate heat exchanger 1' has a first passage 51 that extends along the casing 10 and the first sides 24 of the heat transfer plates 20. The first passage 51 has a fluid outlet section 53. The plate heat exchanger 1' has also a second passage 52, which extends along the casing 10 and the second sides 25 of the heat transfer plates 20. The second passage 52 is, as seen across the heat transfer plates 20, opposite the first passage 51. The second passage 52 has a fluid inlet section 56. The first passage 51 has a fluid inlet 5 and the second passage 52 has a fluid outlet 6.

The plate heat exchanger 1' has in its passages 51, 52 no fluid blockers like the fluid blockers 63 and 64 previously described. All other features are same, but the absence of fluid blockers provides another flow path for the second fluid that results in a one pass configuration. The absence of fluid blockers gives a general flow path of the second fluid F2 as illustrated by the curved arrow marked with reference numeral "F2".

The plate heat exchangers 1 and 1' of FIGS. 3 and 4 respectively FIGS. 18 and 19 each share the same concept in form of passages 51, 52 that extends along the sides of the heat transfer plates 20. The first passage 51 comprises a fluid inlet 5 for the second fluid F2, and a fluid outlet section 53 that faces a section 94 of the second set of flow channels 32. The second fluid F2 may then leave the first passage 51 and enter said section 94 of the second set of flow channels 32.

The second passage 52 has a fluid inlet section 56 that faces said section 94 of the second set of flow channels 32, such that the second fluid F2 may leave said section 94 of the second set of flow channels 32 and enter the second passage 52. The second passage 52 has also the fluid outlet 6 for the second fluid F2.

Since the plate heat exchanger 1' of FIGS. 18 and 19 has no fluid blockers in its passages 51, 52, there is only one section 94 of the second set of flow channels 31. The plate heat exchanger 1 of FIGS. 3 and 4 has two fluid blockers for its passages and has thus three sections 94, 95, 96 of the second set of flow channels 32. Each section 94, 95, 96 represents one fluid pass for the second fluid F2.

Other embodiments are conceivable. For example, in a two pass configuration for the second fluid the heat exchanger has the fluid blocker 63 (see FIG. 4) but not the fluid blocker 64. The fluid blocker is then typically arranged in the middle of the second passage 52. The outlet of the second passage 52 would then be an outlet that faces a second section of the second set of flow channels 32, and the first passage 51 would then have an outlet similar to fluid outlet 6 shown in FIG. 4.

It is possible to have a different number of passages for the first and second fluids, e.g. one pass for the first fluid and two passes for the second fluid.

As indicated, the fluid outlet 43 of the first distribution tube 41 has the form of an opening 101 and the fluid inlet 46 of the second distribution tube 42 has the form of a similar opening 102. Thus, the distribution tubes 41, 42 each have at least one opening 101, 102 (through hole in the tube), and these openings 101, 102 are openings to the same flow channels of the first set of flow channels 31. The outlets and inlets in the distribution tubes of the embodiment shown in FIGS. 3 and 4 have corresponding openings.

The fluid outlet 53 of the first passage 51 and the fluid inlet 56 of the second passage 52 have at least one respective opening in form of interspaces 103, 104 at opposite, peripheral edges 105, 106 of the heat transfer plates. These interspaces 103, 104, or gaps, provide fluid access to the same flow channels of the second set of flow channels 32. The inlets and outlets 54, 55, 57, 58 shown in FIG. 4 are also formed by corresponding interspaces, or gaps, between the heat transfer plates.

From above follows that, for a two pass configuration, for the first fluid the first distribution tube comprises a further (second) fluid inlet and a further (second) fluid outlet for the first fluid. The further inlet is similar to the inlet 44 of FIG. 3 and the outlet is then an outlet similar to the outlet 4 shown in FIG. 3, but arranged on the first distribution tube. A fluid blocker like the blocker 61 separates the further fluid inlet from the (first) fluid outlet of the first distribution tube, such that the further fluid inlet faces at least a further (second) section of the first set of flow channels. The fluid outlet of the second distribution tube then faces said further section of the first set of flow channels, such that the first fluid may leave the second distribution tube and enter said further section of the first set of flow channels, and leave said further section of the first set of flow channels and enter the first distribution tube via its further fluid inlet.

For the two pass configuration the first passage comprises a further fluid inlet, a further fluid outlet for the second fluid, and a fluid blocker that separates the further fluid inlet from the fluid outlet of the first passage. The further outlet is then an outlet similar to the outlet 6 shown in FIG. 3, but arranged on the first passage. The further fluid inlet faces at least a further section of the second set of flow channels. The fluid outlet of the second passage faces said further section of the second set of flow channels, such that the second fluid may leave the second passage and enter said further section of the second set of flow channels, and leave said further section of the second set of flow channels and enter the first passage via its further fluid inlet.

For the three pass configuration of FIGS. 3 and 4 with the fluid blocker 62, the further (second) outlet of the first distribution tube 41 is the outlet 45, while the second distribution tube 42 has a further inlet 48 an a further outlet 4. With the fluid blocker 64 the further (second) outlet of the first passage 51 is the outlet 55, while the second passage 52 has a further inlet 58 and a further outlet 6.

From the description above follows that, although various embodiments of the invention have been described and shown, the invention is not restricted thereto, but may also be embodied in other ways within the scope of the subject-matter defined in the following claims. For example, the plate heat exchanger may be arranged with a different number of fluid blockers and other locations of the heat exchanger fluid inlets and outlets. Thus, even though three so called passes for the fluids are illustrated, another number of passes for the fluids may be accomplished just as well.

The invention claimed is:

1. A plate heat exchanger comprising a casing defining a sealed enclosure, the casing comprising a shell possessing an inner surface, a number of heat transfer plates with a respective first port opening, second port opening, first side and second side that is opposite the first side, wherein the heat transfer plates are arranged within the sealed enclosure of the casing and joined to each other such that a first set of flow channels for a first fluid is formed by every second interspace between the heat transfer plates, with fluid entries and fluid exits at the first and the second port openings, a second set of flow channels for a second fluid is formed by every other, second interspace between the heat transfer plates, with fluid entries and fluid exits at the first and second sides, wherein a first distribution tube that extends through the first port openings of the heat transfer plates and comprises: a fluid inlet for the first fluid; and a fluid outlet that faces at least a section of the first set of flow channels, such that the first fluid may leave the first distribution tube and enter said section of the first set of flow channels, a second distribution tube that extends through the second port openings of the heat transfer plates and comprises: a fluid inlet that faces said section of the first set of flow channels, such that the first fluid may leave said section of the first set of flow channels and enter the second distribution tube; and a fluid outlet for the first fluid, a first passage that extends along the casing and that is formed by a space between the inner surface of the shell and the first sides of the heat transfer plates, the first passage comprising: a fluid inlet for the second fluid; and a fluid outlet that faces at least a section of the second set of flow channels, such that the second fluid may leave the first passage and enter said section of the second set of flow channels, a second passage that extends along the casing and that is formed by a space between the inner surface of the shell and the second sides of the heat transfer plates, the second passage comprising: a fluid inlet that faces said section of the second set of flow channels, such that the second fluid may leave said section of the second set of flow channels and enter the second passage; and a fluid outlet for the second fluid, and a first fluid blocker positioned at an intermediate position along a length of the first distribution tube and a second fluid blacker positioned at an intermediate position along a length of the second distribution tube so that the first fluid blocker is spaced from opposite ends of the first distribution tube and so that the second fluid blocker is spaced from opposite ends of the second distribution tube to block fluid flow so that fluid flow is unable to flow past the first and second fluid blockers to downstream portions of the first distribution tube and the second distribution tube.

2. A plate heat exchanger according to claim 1, wherein the fluid outlet of the first distribution tube and the fluid inlet of the second distribution tube have at least one respective opening to the same flow channels of the first set of flow channels, and the fluid outlet of the first passage and the fluid inlet of the second passage have at least one respective opening in a form of interspaces at opposite, peripheral edges of the heat transfer plates, wherein the interspaces provide fluid access to the same flow channels of the second set of flow channels.

3. A plate heat exchanger according to claim 1, wherein the first distribution tube comprises a further fluid inlet, a further fluid outlet for the first fluid, and the first fluid blocker separates the further fluid inlet from the fluid outlet of the first distribution tube, such that the further fluid inlet faces at least a further section of the first set of flow channels, the fluid outlet of the second distribution tube faces said further section of the first set of flow channels, such that the first fluid may leave the second distribution tube and enter said further section of the first set of flow channels, and leave said further section of the first set of flow channels and enter the first distribution tube via its further fluid inlet.

4. A plate heat exchanger according to claim 1, wherein the first passage comprises a further fluid inlet, a further fluid outlet for the second fluid, and the first fluid blocker separates the further fluid inlet from the fluid outlet of the first passage, such that the further fluid inlet faces at least a further section of the second set of flow channels, the fluid outlet of the second passage faces said further section of the second set of flow channels, such that the second fluid may leave the second passage and enter said further section of the second set of flow channels, and leave said further section of the second set of flow channels and enter the first passage via its further fluid inlet.

5. A plate heat exchanger according to claim 1, wherein a number of the heat transfer plates have a shape of a circular disc with two cut sides that form the first side and the second side that is opposite the first side.

6. A plate heat exchanger according to claim 1, wherein at least one heat transfer plate of the number of heat transfer plates comprises:

a number of rows where each row has alternating ridges and grooves that extend along a central plane of the heat transfer plate, between a top plane and a bottom plane of the heat transfer plate, the top plane and bottom plane being substantially parallel to the central plane and located on a respective side of the central plane, where a transition between each ridge and adjacent groove in the same row is formed by a portion of the heat transfer plate that is inclined relative to the central plane, and plate portions that extend along the central plane of the heat transfer plate, between the rows of ridges and grooves such that the rows are separated from each other.

7. A plate heat exchanger according to claim 6, wherein at least some of the rows of alternating ridges and grooves are parallel to the first side and to the second side.

8. A plate heat exchanger according to claim 1, wherein the first and second distribution tubes extend from a top cover to a bottom cover of the casing.

9. A plate heat exchanger according to claim 8, wherein the first and second distribution tubes are attached to the top cover and to the bottom cover.

10. A plate heat exchanger according to claim 8, wherein the first and second distribution tubes extend from the top cover to the bottom cover of the casing, and extend further through each of the top cover to the bottom cover.

11. A plate heat exchanger according to claim 1, comprising two end plates each arranged on a respective side of the joined heat transfer plates, wherein the first and second distribution tubes are attached to each of the end plates.

12. A plate heat exchanger according to claim 1, comprising a by-pass blocker arrangement that is located in gaps that are formed at the peripheral edges of a plurality of the heat transfer plates that are adjacent one another.

13. A plate heat exchanger according to claim 12, wherein the by-pass blocker arrangement comprises a sealing element that extends along the peripheral edges of said number of adjacent heat transfer plates and abuts an inner surface of the casing, and a number of protrusions that extend into the gaps.

14. A plate heat exchanger according to claim 3, wherein the first fluid blocker in the first distribution tube comprises a disc with a peripheral edge that is attached to an interior of the first distribution tube.

15. A plate heat exchanger according to claim 4, wherein the first fluid blocker in the first passage comprises a peripheral edge that extends along the first side of one heat transfer plate of the number of heat transfer plates and along an inner surface of the casing.

16. A plate heat exchanger according to claim 15, wherein the first fluid blocker in the first passage is integral with said one heat transfer plate.

17. A plate heat exchanger according to claim 4, comprising a rod that extends along the first passage, from an interior support surface of the casing and to the first fluid blocker in the first passage, such that the first fluid blocker in the first passage is supported in a direction along the first passage.

18. A plate heat exchanger comprising a casing, a number of heat transfer plates with a respective first port opening, second port opening, first side and second side that is opposite the first side, wherein the heat transfer plates are arranged within the casing and joined to each other such that:

a first set of flow channels for a first fluid is formed by every second interspace between the heat transfer plates, with fluid entries and fluid exits at the first and the second port openings, and a second set of flow channels for a second fluid is formed by every other, second interspace between the heat transfer plates, with fluid entries and fluid exits at the first and second sides, wherein a first distribution tube that extends through the first port openings of the heat transfer plates and comprises: a fluid inlet for the first fluid; and a fluid outlet that faces at least a section of the first set of flow channels, such that the first fluid may leave the first distribution tube and enter the section of the first set of flow channels, a second distribution tube that extends through the second port openings of the heat transfer plates and comprises: a fluid inlet that faces the section of the first set of flow channels, such that the first fluid may leave the section of the first set of flow channels and enter the second distribution tube; and a fluid outlet for the first fluid, a first passage that extends along the casing and the first sides of the heat transfer plates and comprises: a fluid inlet for the second fluid; and a fluid outlet that faces at least a section of the second set of flow channels, such that the second fluid may leave the first passage and enter the section of the second set of flow channels, a second passage that extends along the casing and the second sides of the heat transfer plates and comprises: a fluid inlet that faces the section of the second set of flow channels, such that the second fluid may leave the section of the second set of flow channels and enter the second passage; and a fluid outlet for the second fluid, the first distribution tube comprising a further fluid inlet, a further fluid outlet for the first fluid, and a fluid blocker that separates the further fluid inlet from the fluid outlet of the first distribution tube, such that the further fluid inlet faces at least a further section of the first set of flow channels, and the fluid outlet of the second distribution tube faces the further section of the first set of flow channels, such that the first fluid may leave the second distribution tube and enter the further section of the first set of flow channels, and leave the further section of the first set of flow channels and enter the first distribution tube via its further fluid inlet.

19. A plate heat exchanger comprising:

a casing;

a number of heat transfer plates with a respective first port opening, second port opening, first side and second side that is opposite the first side, wherein the heat transfer plates are arranged within the casing and joined to each other such that a first set of flow channels for a first fluid is formed by every second interspace between the heat transfer plates, with fluid entries and fluid exits at the first and the second port openings, a second set of flow channels for a second fluid is formed by every other, second interspace between the heat transfer plates, with fluid entries and fluid exits at the first and second sides, a first distribution tube extending through the first port openings of the heat transfer plates and comprising: a fluid inlet for the first fluid; and a fluid outlet that faces at least a section of the first set of flow channels, such that the first fluid may leave the first distribution tube and enter said section of the first set of flow channels;

a second distribution tube extending through the second port openings of the heat transfer plates and comprising: a fluid inlet that faces said section of the first set of flow channels, such that the first fluid may leave said section of the first set of flow channels and enter the second distribution tube; and a fluid outlet for the first fluid;

a first passage extending along the casing and the first sides of the heat transfer plates and comprising: a fluid inlet for the second fluid; and a fluid outlet that faces at least a section of the second set of flow channels, such that the second fluid may leave the first passage and enter said section of the second set of flow channels;

a second passage extending along the casing and the second sides of the heat transfer plates and comprising: a fluid inlet that faces said section of the second set of flow channels, such that the second fluid may leave said section of the second set of flow channels and enter the second passage; and a fluid outlet for the second fluid; and a fluid blocker positioned at an intermediate position along a length of at least one of the first distribution tube and the second distribution tube so that the fluid blocker is spaced from opposite ends of the at least one of the first distribution tube and the second distribution tube to block fluid flow so that fluid flow is unable to flow past the fluid blocker to a downstream portion of the at least one of the first distribution tube and the second distribution tube.

* * * * *